United States Patent [19]

Huddart

[11] 4,454,558

[45] Jun. 12, 1984

[54] SOLENOID DRIVE CIRCUIT

[75] Inventor: David Huddart, Malmesbury, England

[73] Assignee: U.S. Philips Corporation, New York, N.Y.

[21] Appl. No.: 399,169

[22] Filed: Jul. 19, 1982

[30] Foreign Application Priority Data

Jul. 31, 1981 [GB] United Kingdom ..... 8123482

[51] Int. Cl.[3] ..... H01H 47/22

[52] U.S. Cl. ..... 361/153; 361/155; 361/156; 323/282

[58] Field of Search ..... 361/152W1, 155, 156, 361/153; 323/282

[56] References Cited

U.S. PATENT DOCUMENTS

Re. 30,150 11/1979 Puoogel ..... 361/152
4,016,461 4/1977 Roland ..... 323/282

OTHER PUBLICATIONS

IBM Technical Disclosure, vol. 12, No. 7, Dec. 1969, pp. 963–964, "Capacitor Discharge Print Wire Drive" by Boothroyd.

"Current Capacity of Three-Terminal Regulator Expands Fivefold" by Houer, Electronic Design, vol. 27, Dec. 20, 1979, p. 94.

*Primary Examiner*—George H. Miller, Jr.
*Assistant Examiner*—Derek Jennings
*Attorney, Agent, or Firm*—Robert T. Mayer; Bernard Franzblau

[57] ABSTRACT

A solenoid drive circuit for a matrix printer comprises a capacitor (C1) connected in parallel with the series arrangement of a first diode (D2), the solenoid coil (L1), and the collector-emitter path of a transistor (T1). A second diode (D3) is connected in parallel with the coil (L1) and transistor (T1). The capacitor is charged from a d.c. supply which includes a switching regulator (10, T10) via a diode (D1). When the transistor is switched ON by a print signal applied to a terminal (4) the capacitor is discharged resonantly into the coil. The first diode (D2) prevents current flow from the solenoid to the capacitor during the negative half cycle of the resonant frequency so that current in the coil circulates in the loop formed by the coil, the transistor and the second diode. When the transistor is switched OFF the current flowing in the coil is discharged via a further diode (D4) into the storage capacitor (C10) of the d.c. power supply to increase the efficiency of the drive circuit. The print signal is also fed to an inhibit input of the pulse width modulator (10) to switch OFF transistor (T10) during the print operation.

8 Claims, 2 Drawing Figures

Figure 2A:
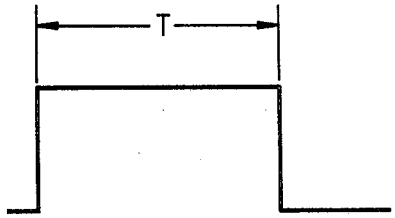

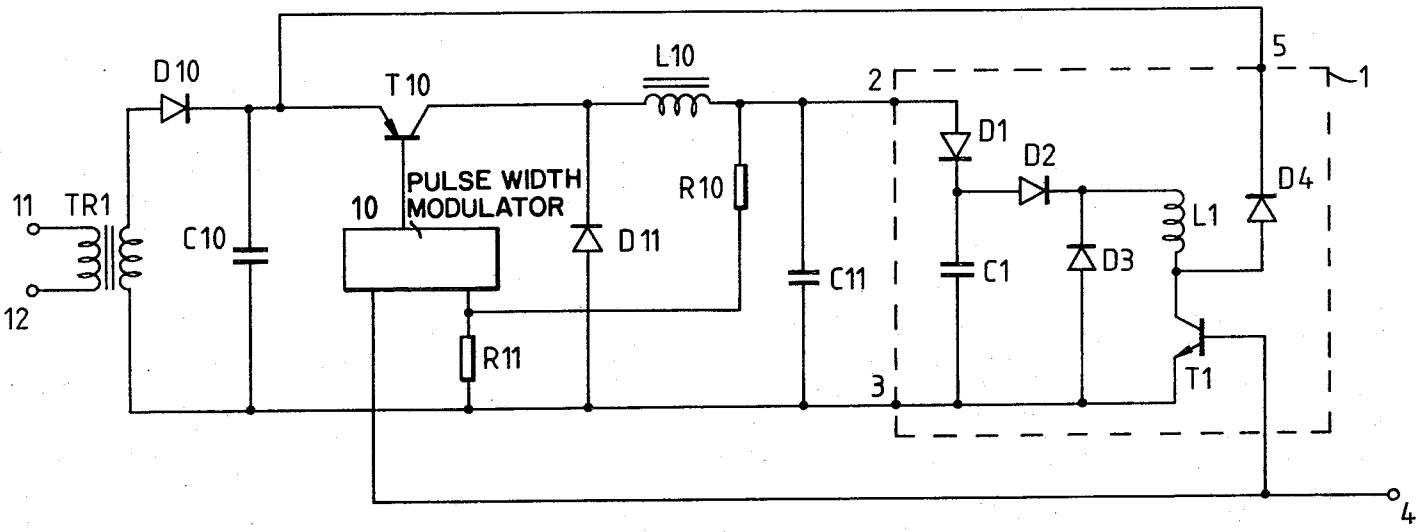
FIG.I

SOLENOID DRIVE CIRCUIT

This invention relates to a solenoid drive circuit comprising a solenoid, a switching device connected in series with the solenoid, means for applying an operate signal to the switching device, and a capacitor which is arranged to be discharged resonantly through the solenoid when the operate signal is applied to the switching device.

Solenoid drive circuits are used in impact printers. A particular type of such matrix printers form characters from a matrix of dots, each character being, for example, seven dots high and five dots wide. Such matrix printers are provided with seven fine wires which are selectively operated by individual solenoids to make impressions on paper. In order to achieve high writing speeds the build up of current in the solenoids has to be rapid and currently used drive circuits consume a large amount of power, the majority of which is dissipated in the transistor which switches the current into the solenoid. This power has to be dissipated which leads to a fairly massive heat sink structure to prevent overheating of the component.

A solenoid drive circuit as described in the opening paragraph is disclosed in IBM Technical Disclosure Bulletin, Volume 12, No. 7, December 1969 at pages 963 and 964. In this circuit the rates of increase and decrease of current in the solenoid coil are equal and are determined by the resonant frequency of the capacitor and the solenoid coil. The operate time of the solenoid coil is also determined by the resonant frequency of the capacitor and solenoid coil which means that the value of these quantities cannot be independently selected.

It is an object of the invention to provide an alternative solenoid drive circuit in which the operate time and fall time of the current in the solenoid coil are independent of the resonant frequency of the capacitor and solenoid coil.

The invention provides a solenoid drive circuit as described in the opening paragraph characterised in that the series arrangement of a first diode, the solenoid and the swtiching device is connected in parallel with the capacitor and that a second diode is connected in parallel with the series arrangement of the solenoid and the switching device, the first and second diodes being effective to cause an electric charge to be transferred from the capacitor to the solenoid only during the first quarter cycle of the resonant frequency after the switching device is turned on, current circulating in the loop formed by the solenoid, the switching device and the second diode being effective to hold the solenoid operated for the remainder of the period of the operate signal.

By use of the first and second diodes current is prevented from flowing from the solenoid to the capacitor during the second quarter cycle of the resonant frequency but instead flows round the loop formed by the switching device, the second diode and the solenoid until the switching device is turned off. The current in the loop will decay due mainly to the resistance of the solenoid but will retain sufficient magnitude to hold the solenoid operated for the period required by the printer.

The capacitor may be charged from a voltage source including a switching regulator. This provides a high efficiency of charge transfer to the capacitor as no series resistance is present to absorb power.

The solenoid operate signal may be fed to an inhibit input of the pulse width modulator in the switching regulator. This ensures that the power supply does not attempt to charge the capacitor in the drive circuit while the solenoid is being operated.

A third diode may be connected between the junction of the solenoid and the switching device and the power supply to feed back energy from the solenoid to the power supply. This increases the efficiency of the drive circuit as the charge on the solenoid is returned to the power supply at the end of the print cycle.

An embodiment of the invention will now be described, by way of example, with reference to the accompanying drawings, in which:

FIG. 1 shows a circuit diagram of a solenoid drive circuit according to the invention, and FIG. 2 shows some waveforms occurring in the circuit shown in FIG. 1.

FIG. 1 shows a drive circuit 1 for the solenoids of a dot matrix printer, a plurality of such circuits being provided, one for each printer solenoid. The drive circuit 1 has inputs 2 and 3 for applying a direct voltage supply to the drive circuit. The series arrangement of a diode D1 and a capacitor C1 is connected between the inputs 2 and 3. The series arrangement of a diode D2, the printer solenoid coil L1 and the collector-emitter path of a transistor T1 is connected between the junction of the diode D1 and capacitor C1 and the input 3. A further diode D3 is connected across the series arrangement of the coil L1 and the collector-emitter path of the transistor T1.

The direct voltage supply is derived from an a.c. mains voltage supply via terminals 11 and 12 which are connected to the primary winding of a transformer TR1. A diode D10 is connected in series with the secondary winding of the transformer to produce a rectified a.c. voltage which is smoothed by a capacitor C10. This voltage is fed to the emitter of a transistor T10 which forms part of a switching voltage regulator. The collector of transistor T10 is connected to one end of an inductor L10 the other end of which is connected to the input 2 of each drive circuit 1 and to one side of a capacitor C11. The other side of capacitor C11 is connected to the input 3. A diode D11 is connected between the junction of the collector of transistor T10 and the inductor L10 and the input 3. The input 3 is connected to the opposite end of the secondary winding of transformer TR1 to that to which the diode D10 is connected. The junction of inductor L10 and capacitor C11 is connected via a resistor R10 to a control input of a pulse width modulator 10, the control input also being connected via a resistor R11 to the input 3. The output of the pulse width modulator 10 is connected to the base of transistor T10. A print signal is applied via a terminal 4 to the base of transistor T1 and to an inhibit input of the pulse width modulator 10. A diode D4 is connected via an output 5 of the driver circuit to the junction of the diode D10, transistor T10, and capacitor C10.

Figure 2B:
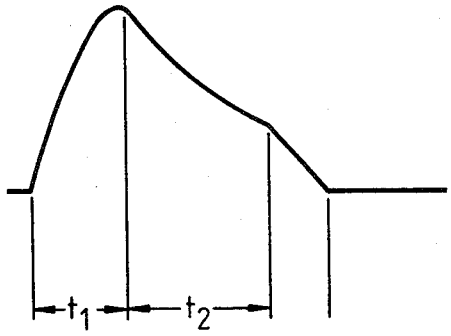

In operation the pulse width modulator 10 and transistor T10 act as a switching regulator to charge the capacitor C1 via the diode D1 when no print signal is present on terminal 4. Under these conditions transistor T1 is switched OFF and hence no current can pass through the coil L1. When a print signal, as shown in FIG. 2*a*, is applied at terminal 4 the transistor T1 is turned ON and the capacitor C1 is discharged through the coil L1. The capacitor C1 and coil L1 form a resonant circuit and hence the current in the coil L1 increases sinusoidally during the period $t_1$ as shown in FIG. 2*b*. At the end of the period $t_1$ the diode D2 becomes reverse biassed and the current circulates round the loop formed by coil L1, transistor T1 and diode D3 and decays exponentially during the period $t_2$ due to the resistance of the coil.

Thus the period $t_1$ is determined by the resonant frequency of the capacitor C1 and coil L1 while the period $t_2$ is equal to $T-t_1$. The droop in the current through the coil L1 is determined by the inductance of the coil L1 and the series resistance of the coil L1, the diode D3 and the transistor T1. Ideally the resistance in the loop formed by L1, T1 and D3 would be zero in which case the current through the coil in the period $t_2$ would be constant but in practice some resistance is inevitably present causing the current to decay. The presence of the diodes D2 and D3 enables the periods $t_1$ and $t_2$ to be independently selected since they prevent current in the coil from flowing back into the capacitor C1. Thus the resonant frequency of the capacitor C1 and coil L1 can be chosen to give a desired rise time for the current in the coil L1 while the period $t_2$ is chosen to give the required duration of the current pulse. When the print signal disappears after the period T the current in the coil L1 decays substantially linearly through the diode D4 returning a charge to the storage capacitor C10 of the power supply unit. The rate of decay depends on the inductance of the coil L1 and the value of the supply voltage at capacitor C10. The diodes D2 and D3 prevent the current in the coil from reversing direction and flowing back into the capacitor C1. The print signal is also fed to the pulse width modulator 10 to inhibit its action so that the transistor T10 is switched OFF during the period T. This prevents current from being fed from the power supply to the driver circuits 1 during the print operation. It should be noted that the capacitor C11 has a lower capacitance than the capacitor C1 and hence will not supply a significant charge to the capacitor C1 during the print operation. The purpose of capacitor C11 is to provide a monitoring voltage for the regulator. It would, alternatively, be possible to omit the link between terminal 4 and the pulse width modulator 10 so that a current will be fed to the drive circuits 1 during the print operation, in which case an additional current will flow through the solenoid L1.

The d.c. power supply may comprise a switched mode power supply circuit in which case the pulse width modulator 10 would form a part of the switched mode circuit and may conveniently be a part of an integrated circuit sold by Mullard Limited under the type number TDA 2640.

The transistor T1 could be replaced by any other convenient switching device such as a field effect transistor or a thyristor. Typically seven drive circuits are provided in a printer but the actual number will depend on the number of dots used to generate a line of the character. In some applications, in order to increase the speed of generation of the characters, two sets of print heads may be used, each being operated alternately.

I claim:

1. A solenoid drive circuit comprising a solenoid, first and second diodes, a capacitor, a switching device connected in series arrangement with the solenoid, input means for applying an operate signal to the switching device which determines an operation period for the drive circuit, means connecting the first diode, the solenoid and the switching device in a first series circuit which is connected in parallel with the capacitor, means connecting the second diode in parallel with the series arrangement of the solenoid and the switching device, said capacitor and solenoid together forming a resonant circuit having a resonant period whereby the capacitor will be resonantly discharged through the solenoid under control of said operate signal, and wherein the first and second diodes are operative to cause electric charge to be transferred from the capacitor to the solenoid only during the first quarter cycle of the resonant period of the resonant circuit and being operative to allow current to circulate in a loop formed by the solenoid, the switching device and the second diode thereby to hold the solenoid operated for the remainder of the operation period of the operate signal.

2. A solenoid drive circuit as claimed in claim 1 further comprising a power supply including a switching regulator for charging said capacitor.

3. A solenoid drive circuit as claimed in claim 2 wherein the switching regulator includes a pulse width modulator for controlling a switching element of the switching regulator, said pulse width modulator having an inhibit input connected to said input means for applying an operate signal.

4. A solenoid drive circuit as claimed in any preceding claim, wherein said solenoid drive circuit comprises a third diode connected between a junction of the solenoid and the switching device and said power supply to feed back energy from the solenoid to the power supply.

5. A solenoid drive circuit as claimed in any one of claims 1, 2 or 3 wherein said solenoid operates a printing head of an inpact printer.

6. A drive circuit for operating a solenoid for a given time period comprising, first and second diodes, a controlled switching device, a capacitor coupled to a source of DC voltage, means connecting the first diode, the solenoid and the switching device in a first series circuit across the capacitor whereby the capacitor and the solenoid form a resonant circuit, means connecting the second diode to the solenoid and the switching device to form a closed loop circuit therewith, input means for applying an operate signal to a control input of the switching device to turn on the switching device and thereby resonantly discharge the capacitor via the first diode, the solenoid and the switching device during a first time period determined by the resonant circuit, and wherein the first and second diodes are polarized to allow a current to circulate in said closed loop circuit subsequent to said first time period for a second time period that is independent of the resonant circuit resonant period thereby to maintain the solenoid in operation during said second time period, said first and second time periods together constituting said given time period.

7. A drive circuit as claimed in claim 6 further comprising a third diode coupling said solenoid to said source of DC voltage such that when the switching device is switched off a current flows from the solenoid to a storage capacitor in the DC voltage source.

8. A drive circuit as claimed in claim 6 wherein said DC voltage source comprises a switching transistor for coupling a source of DC voltage to the capacitor under the control of an output signal of a pulse width modulator, and wherein said pulse width modulator includes an inhibit input coupled to said input means whereby the switching transistor is turned off by the pulse width modulator in response to the operate signal thereby to isolate the drive circuit from the DC voltage source during operation of the solenoid.

* * * * *